United States Patent [19]

van Sluys

[11] 3,968,331

[45] July 6, 1976

[54] ENCODING AND DECODING SYSTEM FOR QUADRAPHONIC SOUND

[76] Inventor: Robert Nestor Joseph van Sluys, Eindhoven, Netherlands

[22] Filed: July 2, 1974

[21] Appl. No.: 485,204

[30] Foreign Application Priority Data

July 9, 1973 Netherlands ..... 7309536

[52] U.S. Cl. ..... 179/1 GQ

[51] Int. Cl.[2] ..... H04R 5/00

[58] Field of Search ..... 179/1 GQ, 1 G, 100.45 T, 179/100.1 TD, 15 BT

[56] References Cited

UNITED STATES PATENTS

| | | | |
|---|---|---|---|
| 3,218,393 | 11/1965 | Kahn | 179/15 BT |
| 3,564,162 | 2/1971 | Bauer | 179/100.4 C |
| 3,761,628 | 9/1973 | Bauer | 179/1 GQ |
| 3,839,602 | 10/1974 | Takahashi | 179/1 GQ |

OTHER PUBLICATIONS

Multiplex Methods for FM Broadcast of Four–Channel Stereo Signals by Halstead et al., Journal AES, Dec. 1970 pp. 1970, 630.

*Primary Examiner*—Douglas W. Olms

[57] ABSTRACT

Method of encoding quadraphonic signals in four channels, in which for each side the front signal is recorded together with the phase-shifted back signal, and the back signal is recorded together with the supplementarily phase-shifted front signal.

7 Claims, 22 Drawing Figures

ENCODING AND DECODING SYSTEM FOR QUADRAPHONIC SOUND

Figure 1:
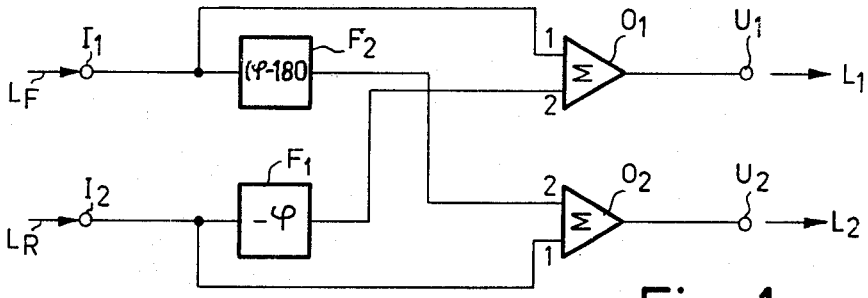

The invention relates to a method of encoding four quadraphonically correlated signals for transmission through (or recording in) four channels.

Such a method is known in which the two stereophonic tracks on a magnetic recording tape are each divided into two channels which each have a width slightly less than one half of the original width. This method has the disadvantage that the signal-to-noise ratio is decreased by about 3dB and in the case of stereophonic playback even by 6 dB if, for example, for a pianoforte solo the signal appears in one channel only. In addition, small departures from the correct track width and track position give rise to further decrease.

According to the invention the said disadvantage is avoided in that in a first channel a first signal from the left is combined with a phase-shifted second signal from the left, in a second channel a second signal from the left is combined with the supplementarily phase-shifted first signal from the left, in a third channel a first signal from the right is combined with a second signal from the right which is shifted in phase preferably in the same manner, and in a fourth channel a second signal from the right is combined with the supplementarily phase-shifted first signal from the right.

This provides the advantage that, if for example a first signal from the left only is present, for example during a pianoforte solo, the capacity of the two channels is fully utilised and the signal-to-noise ratio is substantially unaltered. When recording classical music the capacity is fully utilised by the main information when the two other informations are only supplementary informations, for example signals due to reflections from that part of the hall which is to the rear of the audience. In addition, there is no longer any likelihood of variations in the balance between the first and second signals as a result of poor tracking, because the first and second signals are subjected to the same variations in each channel.

For playing back quadraphonic signals encoded according to the invention, in a decoding method the signal of the first channel is combined with the signal of the second channel shifted through the supplementary phase angle in a direction opposite to that used during encoding to form a new first left signal, the signal of the second channel is combined with the signal of the first channel shifted through a phase angle equal but opposite to that used during encoding to form a new second left signal, the signal of the third channel is combined with the signal of the fourth channel shifted through the supplementary angle in a direction opposite to that used during encoding to form a new first right signal, and the signal of the fourth channel is combined with the signal of the third channel shifted through a phase angle equal but opposite to that used during encoding to form a new second right signal. Thus the fourth initial signals are recovered.

In an embodiment of a device according to the invention a first input leads to a first input of a first adding circuit a second input of which is connected via a first phase-shifting network to a second input which also leads to a first input of a second adding circuit a second input or which is connected, via a second phase-shifting network which impart to the signal a phase-shift supplementary to that of the first phase-shifting network, to the first input, whilst the output of the first adding circuit forms the first output of the device and the output of the second adding circuit forms the second output of the device.

The said device may be used both for encoding and for decoding.

If during encoding the first left signal is applied to the first input and the second left signal is applied to the second input, at the first output the coded signal for the first transmission channel, and at the second output the coded signal for the second output channel, are obtained.

For decoding a second device may be used, the signal from the first transmission channel being applied to the first input and the signal from the second transmission channel being applied to the second input, whilst the phase-shifting networks produce a phase shift which is different by 180° from the corresponding networks of the encoder. Thus the initial first left signal appears at the first output and the initial second left signal appears at the second output.

Alternatively the said device may be used both for encoding and for decoding if during decoding the first channel is not connected to the first input but to the second input whilst the second channel is connected to the first input.

The abovedescribed devices each include two phase-shifting networks, which cannot readily be manufactured in integrated-circuit form.

In another embodiment of a device according to the invention a first input and a second input each are connected to first inputs and second inputs respectively of a first adding circuit and a first subtracting circuit, the output of the first adding circuit being connected to a first input of a second adding circuit and to a first input of a second subtracting circuit, whilst the output of the first subtracting circuit is connected to the second input of the second adding circuit and to the second input of the second subtracting circuit, either the first adding circuit or the first subtracting circuit being immediately succeeded by a phase-shifting network which, when changing over from encoding to decoding, can be switched from the output of the first adding circuit to the output of the first subtracting circuit or conversely.

This provides the advantage that only a single phase-shifting network is required.

If in the decoding operation the signal from the first transmission channel is applied to the second input and the signal from the second transmission channel is applied to the first input, the phase-shifting network need not be switched.

If, however, the first channel is connected to the first input and the second channel is connected to the second input, the phase-shifting network is to be switched.

The phase shift preferably is effected through at least substantially 90°.

In the case of stereophonic playback by means of an apparatus not suitable for quadraphonic playback the two tracks are normally sensed so that the signals from the first and the second channels are combined to form the left signal and the signals from the third and fourth channels are combined to form the right signal. For apparatus suitable for monphonic playback only, the signals from all the four channels are combined.

Figure 3:
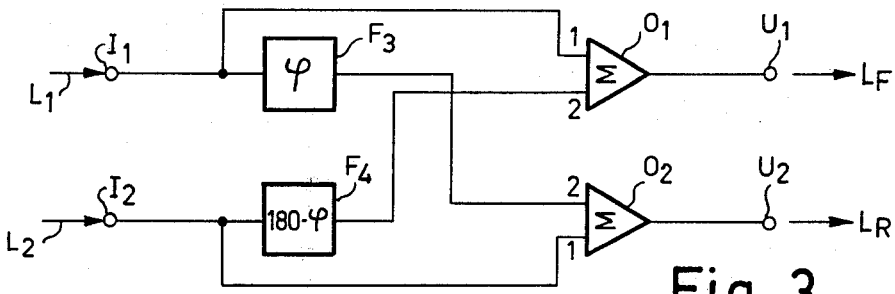
Figure 2:
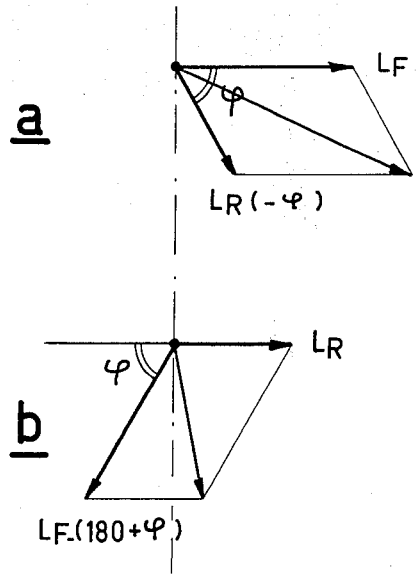
Figure 4:
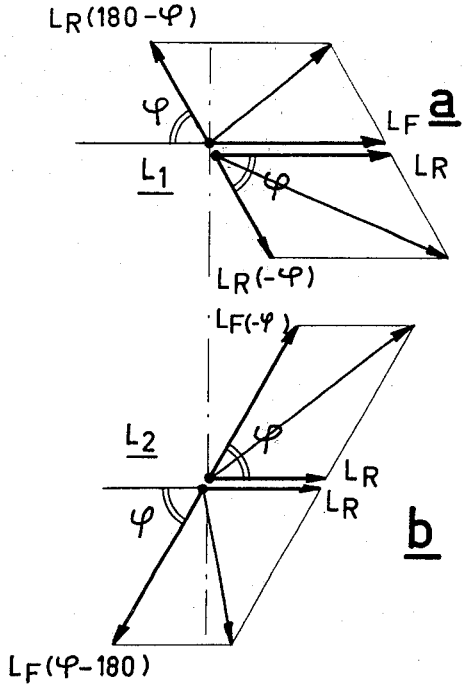
Figure 5:
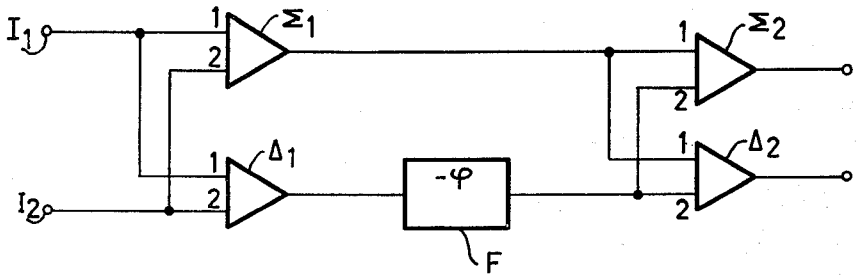
Figure 8:
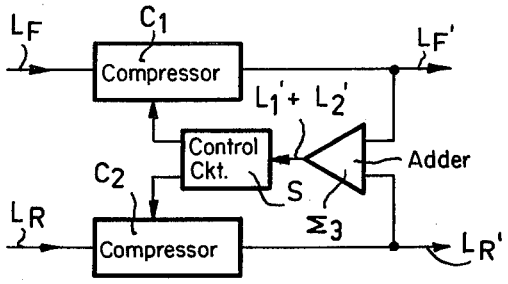
Figure 9:
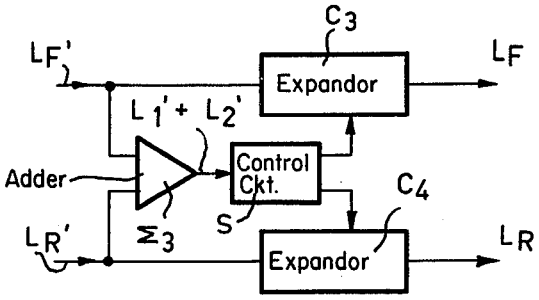
Figure 6:
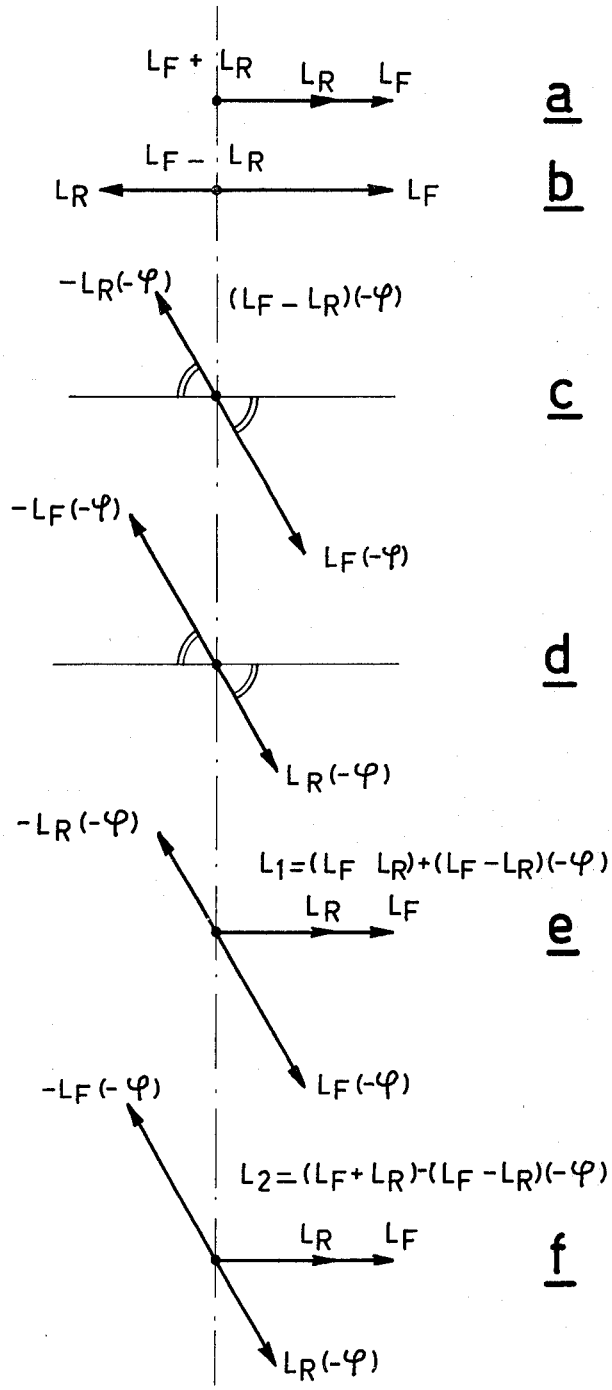
Figure 7:
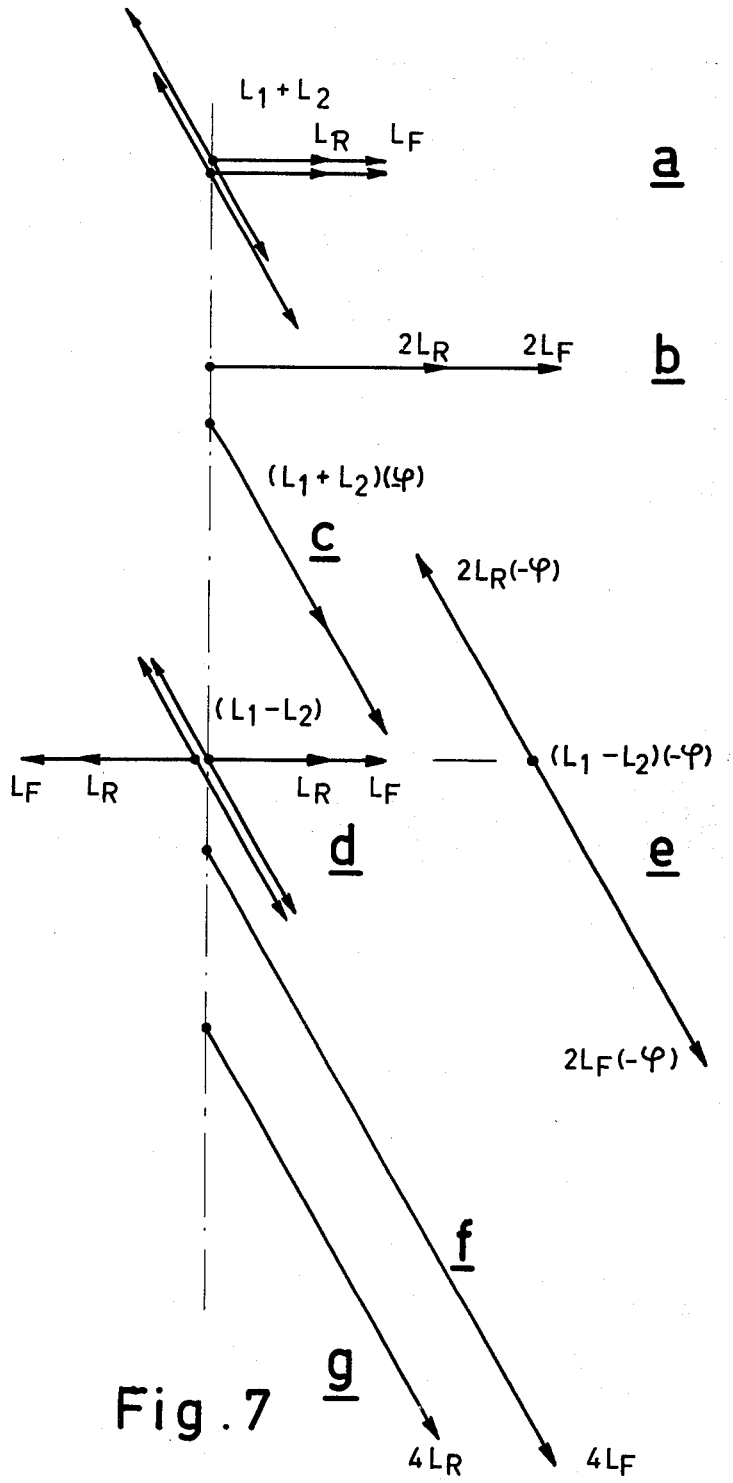

Embodiments of the invention will now be described, by way of example, with reference to the accompanying diagrammatic drawings, in which:

FIG. 1 shows a device according to the invention,

FIG. 2, comprised of *a* and *b*, indicates the manner in which the vectors of the incoming signals rotate, FIG. 3 shows another device according to the invention, FIG. 4, comprised of *a* and *b*, shows how the initial signals are recovered, FIG. 5 shows a device including a single phase-shifting network, FIG. 6, comprised of *a* – *f*, shows the encoding process in the form of vectors, FIG. 7, comprised of *a* – *g*, shows the decoding process in the form of vectors, FIG. 8 shows a compression circuit for use in an encoder according to the invention, and FIG. 9 shows an expansion circuit for use in a decoder according to the invention.

Referring now to FIG. 1, a first left signal $L_F$ is applied to a first input $I_1$ which leads to a first input 1 of a first adding circuit $O_1$. A second input 2 of the adding device is connected via a first phase-shifting network $F_1$, which shifts the phase of the signal through $-\phi°$, to a second input $I_2$ to which a second left signal $L_R$ is applied and which also leads to a first input 1 of a second adding circuit $O_2$.

A second input 2 of the latter adding circuit is connected to the first input $I_1$ via a second phase-shifting network $F_2$ which imparts to the signal a phase shift of $(\phi - 180)°$ supplementary to the phase shift $-\phi$ of the first phase-shifting network $F_1$. Thus when it is said that one phase shift is supplementary to another one, it is meant that they add up to 180°. The output of the first adding circuit $O_1$ forms the first output $U_1$ from which the signal $L_1$ for the first transmission channel can be derived, and the output of the second adding circuit $O_2$ forms the second output $U_2$ from which the signal $L_2$ for the second transmission channel can be derived. The signal for the first channel $L_1 = L_F + L_R(-\phi)$ is shown in FIG. 2*a*, and the signal for the second channel $L_2 = L_R + L_F(\phi - 180)$ is shown in FIG. 2*b*. In the above formulas, $\phi$ and $(\phi - 180)$ indicates the angles through which the associated signals are shifted in phase.

For convenience it is assumed in these vector diagrams that the signals $L_F$ and $L_R$ are equal in phase, but it will be clear that the same effect will be obtained when they differ in phase.

The vector diagrams clearly show that if only one signal, for example the left-front signal $L_F$, is present, this signal still is recorded with equal amplitude in both tracks, whereas when recording classical music, in which case the left-back signal $L_R$ and the right-back signal $R_R$ are only signals which are reflected at the rear of the hall, the capacity of the transmission channels, for example the degree of drive of a magnetic recording tape, is fully utilised.

For the right-front signal $R_F$ and the right-back signal $R_R$ an identical device is used, so that what has been described with respect to the left-front and left-back signals $L_F$ and $L_R$ respectively applies again. It will also be clear that the left and right information remain completely separated, ensuring compatibility for stereophonic signals.

FIG. 3 shows an associated decoding device in which the signal from the first transmission channel $L_1$ is applied to a first input $I_1$ and the signal from the second transmission channel $L_2$ is applied to the second input $I_2$. The structure of this device differs from that shown in FIG. 1 only in that the phase-shifting networks $F_3$ and $F_4$ each produce a phase shift which differs by 180° from that produced by the respective corresponding network $F_1$ and $F_2$ and hence is $\phi°$ and $(180-\phi)°$ respectively.

This is shown in FIG. 4*a* with respect to decoding the left-front signal $L_F$. In the first adding circuit $O_1$ the signal from the first transmission channel $L_1$, which signal is shown in FIG. 2*a*, is added to the signal from the second transmission channel $L_2$ shown in FIG. 2*b* after the latter signal has been rotated through an angle of $(180-\phi)°$ in the phase-shifting network $F_3$. The components of $L_R$ are in phase opposition and cancel each other, whilst the components of $L_F$ are added to one another and are derived from the output $U_1$. In the second adding circuit $O_2$ the signal from the second transmission channel $L_2$ is added to the signal from the first transmission channel which in the second phase-shifting network $F_4$ has been shifted through an angle of $\phi°$, as is shown in FIG. 4*b*, so that the signal $L_R$ is available at the output $U_2$.

Alternatively, the same device may be used both for encoding and for decoding if in the decoding process the first transmission channel $L_1$ is connected to the first input $I_1$ and the second transmission channel $L_2$ is connected to the second input $I_2$. Thus, in the case of the device of FIG. 1 the signal from the first transmission channel $L_1$, which signal is shown in FIG. 2*a*, is added in the first adding circuit to the signal from the transmission channel $L_2$, which signal also is shown in FIG. 2*a*, after it has been shifted in phase through an angle of $-\phi°$ by the first phase-shifting network $F_1$. The signal from the transmission channel $L_2$, which signal is shown in FIG. 2*b*, is shifted through an angle of $(\phi-180)°$ by the second phase-shifting network $F_2$ and then added to the signal from the transmission channel $L_1$ by the second adding circuit $O_2$. Thus, the signals $L_F$ and $L_R$ are interchanged so that at the output $U_1$ the signal $L_R$ is available and at the output $U_2$ the signal $L_F$ is available.

It may be a disadvantage of the abovedescribed devices that they each require two phase-shifting networks.

FIG. 5 shows another embodiment of a device according to the invention which includes only one phase-shifting network. In this device, a first input $I_1$ is connected to first inputs 1 of a first adding circuit $\Sigma_1$ and of a first subtracting circuit $\Delta_1$, whilst a second input $I_2$ is connected to second inputs 2 of these circuits, the output of the first adding circuit $\Sigma_1$ being connected to first inputs 1 of a second adding circuit $\Sigma_2$ and of a second subtracting circuit $\Delta_2$, whilst the output of the first subtracting circuit $\Delta_1$ is connected to second inputs 2 of the second adding circuit $\Sigma_2$ and of the second subtracting circuit $\Delta_2$, the first subtracting circuit $\Delta_1$ being immediately succeeded by a phase-shifting network F which, when the device is switched from the encoding mode to the decoding mode, can be switched to the output of the first adding circuit $\Sigma_1$. During encoding a first left signal $L_F$ is applied to the first input $I_1$ and a second left signal $L_R$ is applied to the second input $I_2$. Thus, a signal $L_F + L_R$ appears at the output of the first adding circuit $\Sigma_1$, and a signal $L_F - L_R$ appears at the output of the first subtracting circuit $\Delta_1$, the latter signal being shifted in the phase-shifting network F through an angle of $-\phi°$ to form a signal $(L_F - L_R)(-\phi)$. The sum signal $L_F + L_R$ and the phase-shifted difference signal $(L_F - L_R))-\phi)$ are applied to the inputs 1 and 2 respectively of the second adding circuit $\Sigma_2$, at the output $U_1$ of which a signal $L_1 = (L_F + L_R)+(L_F-L_R)(-\phi)$ appears. This signal is supplied to the first transmission channel. Similarly, at the second output $U_2$ a signal $L_2 = (L_F + L_R)-(L_F-L_R)(-\phi)$ appears, which is supplied to the second transmission channel. This is illustrated by vector diagrams in FIGS. 6*a* to 6*f*.

For decoding, the signal from the first channel $L_1$ is applied to the first input $I_1$ of the circuit, and the signal from the second channel $L_2$ is applied to the second input $I_2$ of the circuit. At the output of the first adding circuit $\Sigma_1$ the signal $L_1 + L_2$ appears, which after being shifted in phase through an angle $-\phi°$ by the phase-shifting network F, which now is connected after the first adding circuit $\Sigma_1$, is converted into the signal $L_3 = (L_1 + L_2)(-\phi)$. The signal $L_1 - L_2$ is produced at the output of the first subtracting circuit $\Delta_1$. The said two signals are converted by the second adding circuit $\Sigma_2$ to form a signal $4L_F$ and by the second subtracting circuit $\Delta_2$ to form a signal $4L_R$.

This is illustrated by the vector diagrams of FIGS. 7*a* to 7*g*.

If in the abovementioned cases the quadraphonically encoded signal $L_1$, $L_2$, $R_1$ and $R_2$ are played back by means of a stereophonic head, obviously a stereophonically compatible signal will be obtained which, if an encoding device according to FIG. 1 or one according to FIG. 3 is used, comprises a left signal and a right signal which are equal to the sum of the signals $L_1$ and $L_2$ and the sum of the signals $R_1$ and $R_2$ respectively. When the device according to FIG. 5 is used the said signals will be $2(L_F + L_R)$ and $2(R_F + R_R)$ respectively.

In the case of playback by means of a monophonic head the output signal will be the sum of all four signals $L_1$, $L_2$, $R_1$ and $R_2$ when using the device of FIG. 1 or of FIG. 3, whilst when the device according to FIG. 5 is used the output signal will be $2(L_F+L_R+R_F+R_R)$. If in the case of quadraphonic recording on tape and subsequent playback the track positions are not entirely correct, the balance between $L_F$ and $L_R$ and that between $R_F$ and $R_R$ remain unchanged, the only adverse effect being a small amount of cross-talk.

Obviously, compression and expansion circuits may be used in the transmission channels for the purpose of noise suppression. The control signal then may be derived from the amplitudes of the signals $L_1$, $L_2$ and $R_1$, $R_2$ respectively. The envelopes of these signals are highly correlated, permitting the use of a common control signal. This is illustrated for the signals $L_F$, $L_R$ and for the signals $R_F$, $R_R$ in FIGS. 8 and 9 respectively.

In FIG. 8, $C_1$ and $C_2$ represent a first and a second compression circuit respectively to which the signals from the first channel $L_1$ and those from the second channel $L_2$ are supplied. From the outputs the compressed signals from the first channel $L_1$ and from the second channel $L_2$ respectively can be derived. The compressed signals are added to one another in an adding circuit $\Sigma_3$ and supplied to a common circuit S from which the two equal control signals for the compression circuits $C_1$ and $C_2$ are derived.

In FIG. 9 the signals $L_1'$ and $L_2'$ are supplied to expansion circuits $C_3$ and $C_4$ respectively from the outputs of which the signals $L_1$ and $L_2$ respectively can be derived. The incoming signals are furthermore added to one another in an adding circuit $\Sigma_3$ the output signal of which is applied to a control circuit S the outputs of which are connected to the expansion circuit $C_3$ and $C_4$.

The compressor of FIG. 8 is connected after the encoding circuit, and the expander of FIG. 9 is connected before the decoding circuit.

What is claimed is:

1. Method of encoding four quadraphonically correlated signals for transmission via four channels, said method comprising combining in a first channel a first left signal with a second left signal which has been shifted in phase, combining in a second channel the second left signal with the first left signal which has been supplementarily shifted in phase with respect to the phase shift of said second left signal in said first channel, combining in a third channel a first right signal with a second right signal which has been shifted in phase, and combining in a fourth channel the second right signal with the first right signal which has been supplementarily shifted in phase with respect to the phase shift of said second right signal in said third channel.

2. Method of decoding four quadraphonically correlated signals which have been encoded in four transmission channels according to the method claimed in claim 1, said method comprising forming a new first left signal by combining the signal from the first channel with the signal from the second channel, which has been shifted in phase through an angle in a sense opposite to that used during encoding of said first channel, forming a new second left signal by combining the signal from the second channel with the signal from the first channel, which has been shifted in phase through an angle equal but opposite to that used during encoding of said second channel, forming a new first right signal by combining the signal from the third channel with the signal from the fourth channel, which has been shifted in phase through an angle in a sense opposite to that used during encoding of said third channel, and forming a new second right signal by combining the signal from the fourth channel with the signal from the third channel, which has been shifted in phase through a phase angle equal but opposite to that used during encoding of said fourth channel.

3. Method as claimed in claim 1, wherein the phase shift is at least 90°.

4. Method as claimed in claim 2, wherein for stereophonic playback the signals from the first and second channels are combined to form the left signal and the signals from the third and fourth channels are combined to form the right signal.

5. Method as claimed in claim 2, wherein for monophonic playback the signals from the four channels are combined.

6. A device for encoding quadraphonic signals comprising first and second device inputs, first and second device outputs, a first adding device having a first input coupled to said first device input and a second input, a first phase-shifting network coupled between said first adder second input and said second device input, a second adding device having a first input coupled to said second device input and a second input, a second phase-shifting network means for imparting to the signal a phase shift which is supplementary to the phase shift produced by the first phase-shifting network coupled between said device first input and said second adder second input, the output of the first adding circuit comprising the first output of the device, and the output of the second adding circuit comprising the second device output.

7. A device for encoding or decoding quadraphonic signals comprising first and second device inputs, first and second device outputs, a first adding circuit and a first subtracting circuit each having first and second inputs coupled to said first and second device inputs respectively, a second adding circuit and a second subtracting circuit and each having first and second inputs, and an output coupled to said device outputs respectively, means for coupling the first adder output to said second circuits first inputs, means for coupling the output of the first subtractor output to said second circuits second inputs, one of the coupling means comprising a phase-shifting network.

* * * * *

UNITED STATES PATENT AND TRADEMARK OFFICE

CERTIFICATE OF CORRECTION

PATENT NO. : 3,968,331
DATED : July 6, 1976
INVENTOR(S) : Robert N. J. Van Sluys It is certified that error appears in the above-identified patent and that said Letters Patent are hereby corrected as shown below:

ON THE TITLE PAGE above "Foreign Application Priority Data" insert --

Assignee: U.S. Philips Corporation, New York, N.Y. --;

Signed and Sealed this

Fifth Day of October 1976

[SEAL]

*Attest:*

RUTH C. MASON
*Attesting Officer*

C. MARSHALL DANN
*Commissioner of Patents and Trademarks*